US006819300B2

(12) United States Patent
Göttl

(10) Patent No.: US 6,819,300 B2
(45) Date of Patent: Nov. 16, 2004

(54) DUAL-POLARIZED DIPOLE ARRAY ANTENNA

(75) Inventor: Maximillan Göttl, Frasdorf (DE)

(73) Assignee: Kathrein-Werke KG, Rosenheim (DE)

( * ) Notice: Subject to any disclaimer, the term of this patent is extended or adjusted under 35 U.S.C. 154(b) by 37 days.

(21) Appl. No.: 10/221,753

(22) PCT Filed: Mar. 15, 2001

(86) PCT No.: PCT/EP01/02962

§ 371 (c)(1),
(2), (4) Date: Oct. 22, 2001

(87) PCT Pub. No.: WO01/69714

PCT Pub. Date: Sep. 20, 2001

(65) Prior Publication Data

US 2003/0090431 A1 May 15, 2003

(30) Foreign Application Priority Data

Mar. 16, 2000 (DE) ..... 100 12 809

(51) Int. Cl.[7] ..... H01Q 21/20
(52) U.S. Cl. ..... 343/799; 343/795; 343/810
(58) Field of Search ..... 343/793, 795, 343/797, 799, 803, 805, 853, 810, 893

(56) References Cited

U.S. PATENT DOCUMENTS

| | | | | |
|---|---|---|---|---|
| 2,538,915 A | | 1/1951 | Rowland | 250/73 |
| 3,475,758 A | | 10/1969 | Vito | 343/799 |
| 4,434,425 A | * | 2/1984 | Barbano | 343/797 |
| 5,173,715 A | | 12/1992 | Rodal et al. | 343/795 |
| 5,481,272 A | | 1/1996 | Yarsunas | 343/797 |
| 5,532,707 A | | 7/1996 | Klinger et al. | 343/793 |
| 5,629,713 A | | 5/1997 | Mailandt et al. | 343/808 |
| 5,940,044 A | | 8/1999 | Smith | 343/810 |
| 6,023,244 A | | 2/2000 | Snygg et al. | 343/700 MS |
| 6,025,812 A | | 2/2000 | Gabriel et al. | 343/797 |
| 6,028,563 A | * | 2/2000 | Higgins | 343/797 |
| 6,310,584 B1 | * | 10/2001 | Reece et al. | 343/816 |

FOREIGN PATENT DOCUMENTS

| | | |
|---|---|---|
| DE | 10 11 010 | 6/1957 |
| DE | 11 60 513 | 1/1964 |
| DE | 4302905 C1 | 3/1994 |
| DE | 19823749 A1 | 12/1999 |
| DE | 19860121 A | 7/2000 |
| EP | 0 362 079 | 4/1990 |
| EP | 0 431 764 | 6/1991 |
| EP | 0 685 900 | 12/1995 |
| WO | 82/02119 | 6/1982 |
| WO | 97/22159 | 6/1997 |
| WO | 98/01923 | 1/1998 |
| WO | 98/36472 | 8/1998 |
| WO | 98/37592 | 8/1998 |
| WO | 98/48480 | 10/1998 |
| WO | 99/17403 | 4/1999 |

OTHER PUBLICATIONS

Alois Krischke: "Rothammels Antennenbuch", 1995, Frankh–Kosmos, Stuttgart, Germany, XP002171898, 25590, Abblidung 13.6.

Rothammel, K; Antennenbuch, Telekosmosverlay, Franckhcsche Verlagshandlung, Stuttgart, 8. Aufl. 1984, S 417–425.

Beckmann C et al.: "Antenna Systems for Polarization Diversity", Microwave Journal, Bd. 40, Nr. 5, 1. (May 1997).

(List continued on next page.)

*Primary Examiner*—Shih-Chao Chen
(74) *Attorney, Agent, or Firm*—Nixon & Vanderhye P.C.

(57) ABSTRACT

An improved dual-polarized dipole antenna has two orthogonal parallel dipoles of a dipole square fed by a feeder point on one of the dipoles. Starting from said feeder point, a connection cable to the feeder point on the respective orthogonal parallel dipole of the dipole square is laid and is electrically connected there to the dipole halves of the dipole square.

9 Claims, 5 Drawing Sheets

OTHER PUBLICATIONS

Heilmann, A.: Antennen, Zweiter Teil, Wien/Zurich, 1970, S. 47–50.

Zehentner, H.: Neue Sendeantenne fur terrestrisches Fernsehen . . . , Berlin, Offenbach, 1994, S. 357–362.

"Dual–Frequency Patch Antennas"; S. Maci and G. Biffi Gentilli, IEEE Antennas and Propagation Magazine, vol. 39, No. 6, Dec. 1997.

* cited by examiner

DUAL-POLARIZED DIPOLE ARRAY ANTENNA

CROSS-REFERENCES TO RELATED APPLICATIONS

Not applicable.

STATEMENT REGARDING FEDERALLY SPONSORED RESEARCH OR DEVELOPMENT

Not applicable.

FIELD

The technology herein relates to a dual-polarized dipole antenna according to the preamble of claim 1.

BACKGROUND AND SUMMARY

As shown in DE 198 23 749 A1 (see also U.S. Pat. No. 6,333,720, entitled "Dual-Polarized Multi-Range Antenna"), a dual-polarized dipole antenna has become known which is suitable for mobile radio networks used throughout the world, particularly the GSM900 or GSM1800 network for transmission in the 900 MHz or 1,800 MHz band.

A generic dual-polarized antenna which has become known uses a polarization orientation of ±45°. The antenna includes a number of dipole squares in a joint antenna housing in front of a reflector. A number of such dipole squares are usually arranged in the vertical direction for transmitting in one frequency. A further different dipole square is provided for transmitting in the other frequency band. For example, the different dipoles may be arranged between two such dipole squares arranged vertically above one another.

The horizontal half-power beam width of the antenna, which is mainly used, is 65°. To make antenna as compact as possible, two single dipoles are often connected together with the same phase in order to achieve the 65° half-power beam width for each polarization. The dipoles are oriented at +45° and −45°, respectively. This results in a so called dipole square, The two horizontal radiation patterns of the +45° and −45° polarizations should be oriented to be coincident, if possible. Any deviation is called tracking.

To achieve a narrower vertical half-power beam width and to increase the antenna gain, a number of dipole squares are often connected together in the vertical direction. If this is done in phase, the two antennas polarized by +45° and −45° do not have any electrical depression. With an antenna dimensioned and arranged like this, there is no or only minimal tracking. The cross-polarized components of the radiation pattern are also minimal.

Today, it is mainly the ±60° sector which is of significance for mobile radio. In recent years, mobile networks have become ever more dense due to the great success of mobile radio. The existing frequencies must be used more economically at closer and closer distances. It the coverage is too dense, interferences are produced. A remedy can be achieved by using antennas having a greater electrical depression, for example a depression angle of up to 15°. However, this has the unpleasant side effect that as the depression angle increases, the two horizontal patterns of the dual-polarized antennas drift apart, i.e. the horizontal pattern polarized +45° drifts in the positive direction and the horizontal pattern polarized −45° drifts in the negative direction. This leads to considerable tracking with large depression angles. Furthermore, the tracking is frequency-dependent. Similarly, the cross-polarized components of the radiation pattern follow the horizontal patterns which leads to a distinct deterioration in the polarization diversity characteristics in the ±60° sector.

It is, therefore, desirable to overcome the disadvantages of the prior art and create an improved dual-polarized antenna.

Using comparatively simple means in the generic dual-polarized dipole antenna, even with a comparatively great depression, it is possible to achieve horizontal patterns do not drift apart or, at least, the drifting-apart is distinctly minimized. On the other hand, the solution according to the exemplary non-limiting illustrative implementation also provides possibilities to achieve a particular tracking, if required, for example in the case of a non-depressed radiation pattern. The resultant improved compensation for the tracking in dependence on frequency is surprising.

Due to the fact that the tracking is eliminated or at least minimized in accordance with the exemplary non-limiting illustrative implementation, the cross-polarized components of the radiation pattern are also distinctly improved. As a consequence, the polarization diversity characteristics are also improved.

A further advantage is also that the overall expenditure of cables can be reduced compared with conventional antenna installations.

The surprising solution according to the exemplary non-limiting illustrative implementation is based on the fact that two opposite parallel dipoles of a dipole square which radiate or, respectively, receive with the same polarization are not fed in parallel or with balanced cables or with separate cables. Rather, the feeding takes place only with respect to one dipole, and a connecting cable is then provided from the feed point at one dipole to the feed at the opposite second, parallel dipole.

Due to the feeding arrangement according to the exemplary non-limiting illustrative implementation, orienting the radiators to +/−45° causes a frequency-dependent squinting of the dipole squares and thus also a drift of the patterns in the horizontal and in the vertical direction. It is completely surprising that this leads to a wide-band improvement in the tracking and additionally reduces the cross-polarized components without impairing the electrical depression. This is all the more surprising as the interconnection of the dipoles according to the exemplary non-limiting illustrative implementation results in a most unwanted narrow-band characteristic of the antenna from the point of view of conventional wisdom and, in addition, a disadvantageous frequency-dependence of the depression angle would be expected.

In a preferred implementation of the exemplary non-limiting illustrative implementation, the electrical length of the connecting cable corresponds to one wavelength $\lambda$ or an integral multiple thereof referred to the center frequency to be transmitted.

Such antennas usually do not comprise only one dipole square but a number of dipole squares arranged, as a rule, above one another in the vertical direction of installation and aligned at a 45° angle to the vertical. Using the present exemplary non-limiting implementation, the tracking can now be preset differently in accordance with the requirements. In a preferred implementation of the exemplary non-limiting illustrative implementation, this can be effected, for example, by feeding, from the feed cable, only at the same side of dipoles aligned with the corresponding polarization and, connecting cables leading to the opposite dipole in the same manner for all dipoles.

A change in the amount of tracking, however, can be implemented by the fact that, for example, the feeding of four dipole squares arranged one above one another takes place with reference to the dipole on the left in three dipole squares with respect to the dipoles arranged in parallel with one another. Only with respect to one dipole square does it take place only with respect to the dipole parallel thereto on the right in an exemplary non-limiting implementation.

If, for example, with reference to four dipole squares, the feeding is only effected at the dipoles on the left in the case of two dipoles and the other half of the feeding is effected only at the dipoles on the right (the feeding with respect to the in each case second parallel dipole taking place via the connecting line), a different value is obtained for the tracking.

The degree and magnitude of the compensation value for the drifting-apart of the +45° and −45° polarized horizontal pattern component can be set correspondingly finely and compensated for. A different proportion is used which in the case of two dipoles oriented in parallel with one another, initial feeding takes place and a dipole is fed via a connecting line coming from there.

In the field of the dual- or cross-polarized antenna, the series feed which can be selected differently if necessary, and can be used for compensating for the frequency-dependence of the radiation patterns and for compensating for the tracking. This is completely surprising and not obvious.

The solution according to the exemplary non-limiting illustrative implementation also provides the further advantage that only one feed cable, provided with a cross section of correspondingly large dimension, to in each case two dipoles located offset by 90° is provided. From these two dipoles, in each case only one connecting cable, provided with a thinner cable cross section, is conducted to the opposite dipole of a dipole square. This distinctly reduces the overall cable expenditure.

BRIEF DESCRIPTION OF THE DRAWINGS

Further advantages and details of the exemplary non-limiting illustrative implementation are found in the example explained in the text as shown in the drawings, of which.

DETAILED DESCRIPTION

Figure 1:
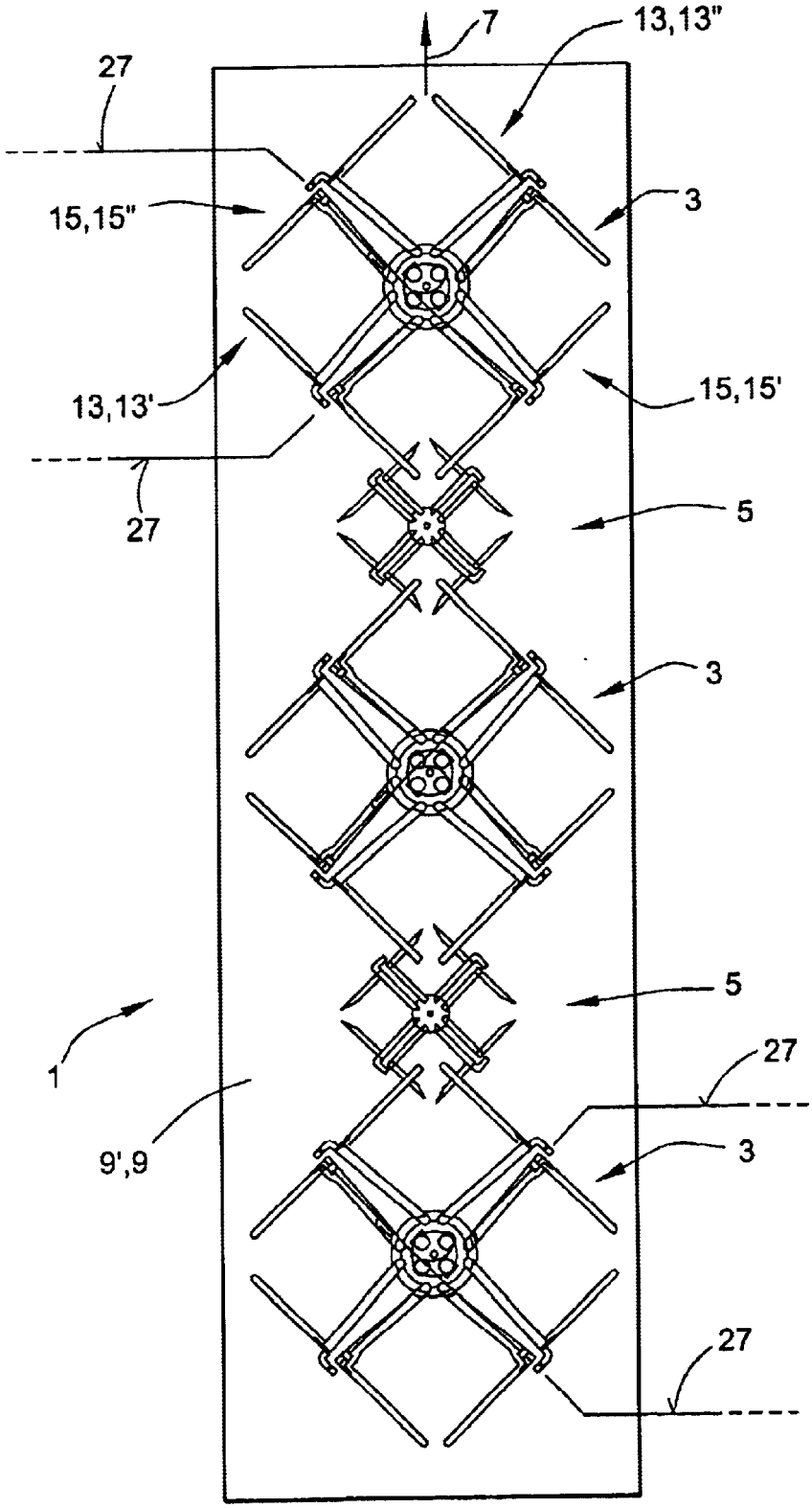
FIG. 1 shows an exemplary non-limiting dual-polarized dipole antenna implementation comprising a number of dipole squares.

FIG. 1 shows a diagrammatic top view of an exemplary non-limiting implementation of dual-polarized dipole antenna 1 having a number of first dipole squares 3 and a number of second dipole squares 5. The first dipole squares 1 are used, for example, for transmitting in the 900 MHz band, The second dipole squares 5 of comparatively smaller dimensions are tuned, for example, for transmission in the 1,800 MHz band. All dipole squares 3 and 5 are oriented inclined by 45° with respect to the vertical and horizontal and arranged along a vertical mounting direction 7 above one another in front of a reflector 9 at a suitable distance in front of the reflector plate 9'.

With respect to the basic configuration and operation, reference is made to the previously published prior art according to DE 198 23 749 A1 (U.S. Pat. No. 6,333,720) to the content of which reference is made in its full extent and which is incorporated as content of the present application.

Figure 2:
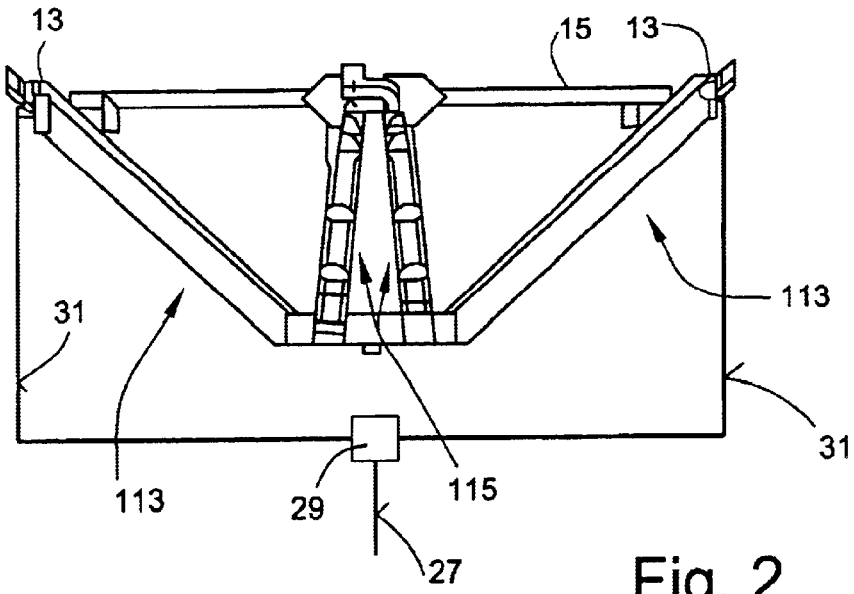
Fig. 2 (PRIOR ART)
FIG. 2 shows a diagrammatic side view of an exemplary dipole square along the direction of arrow A in FIG. 1 with cabling according to the prior art.
Figure 3:
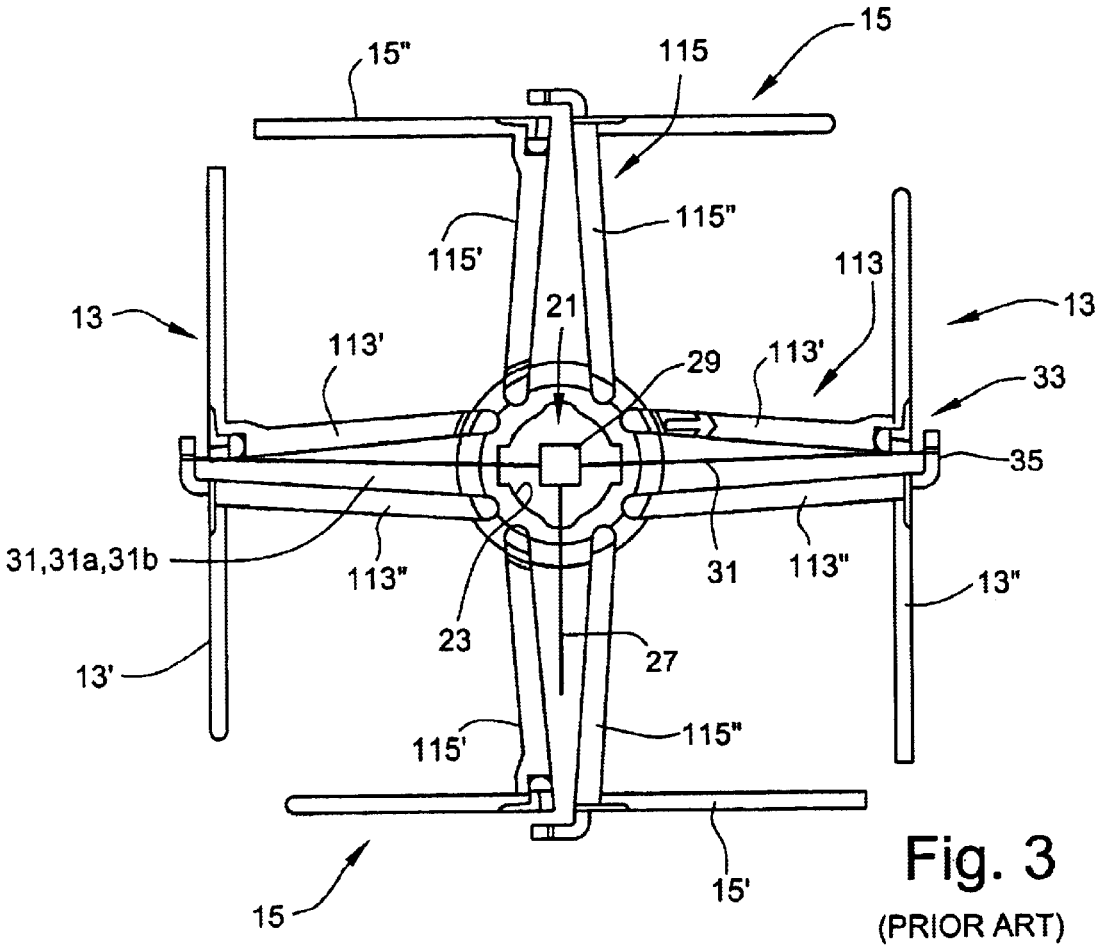
Fig. 3 (PRIOR ART)
FIG. 3 shows a top view of the dipole square of FIG. 2 of the prior art.

These dipole squares, which are basically previously known, have a configuration and a feed according to FIGS. 2 and 3 of the present application.

Figure 4:
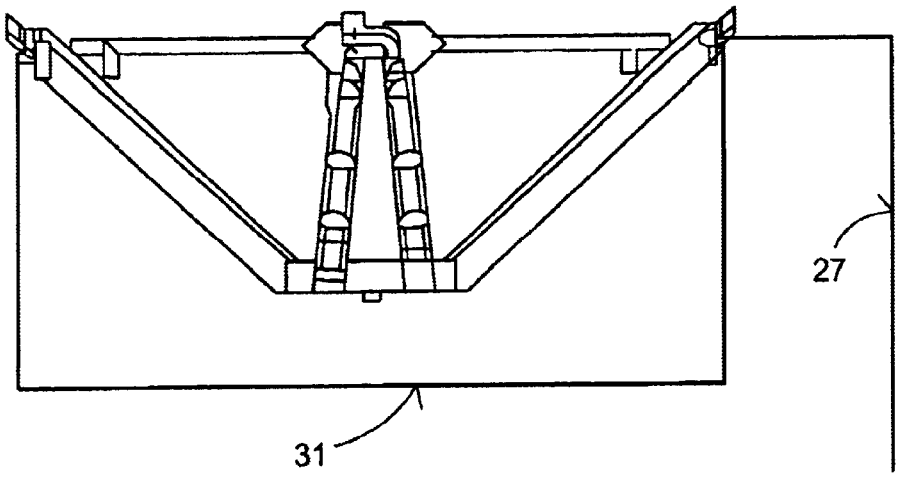
FIG. 4 shows a diagrammatic side view of an exemplary dipole square along the direction of arrow A provided by an exemplary non-limiting illustrative implementation of the technology herein.

The dipole squares in each case comprise two pairs of parallel dipoles 13 and 15 which, according to the top view of FIG. 4, are arranged in the manner of a dipole square. Both dipole pairs 13' and 13" and the two dipole pairs 15' and 15" are carried and held via a balancing arrangement 113' and 113" and, respectively, 115' and 115" which, in the exemplary implementation shown, extend from a base and anchoring area 21 on the reflector 9 with a vertical and in each case outwardly pointing component to the dipole halves located at a distance in front of the reflector 9. A first connecting cable 31 (coaxial cable) is conducted, usually via a hole 23 in the reflector 9, from a feed cable 27 coming behind the reflector 9 in the area of the base point or the anchoring area 21 via a branching point 29 along one support arm of the balancing arrangement 113 to the feed point 33 at which the external conductor 31*a* is electrically joined, for example to the support arm 113'. The internal conductor 31*b* is constructed, separately from this, extended in the axial longitudinal direction over a small distance and is electrically connected to a connecting point or elbow 35 connected to the second dipole half.

The same joining connection is made for the opposite dipole. The electrical feed to the two dipole pairs, located offset by 90°, which are not drawn in FIGS. 2 and 3 for the sake of clarity, is effected via a separate second feed cable and two further separate connecting lines.

Figure 5:
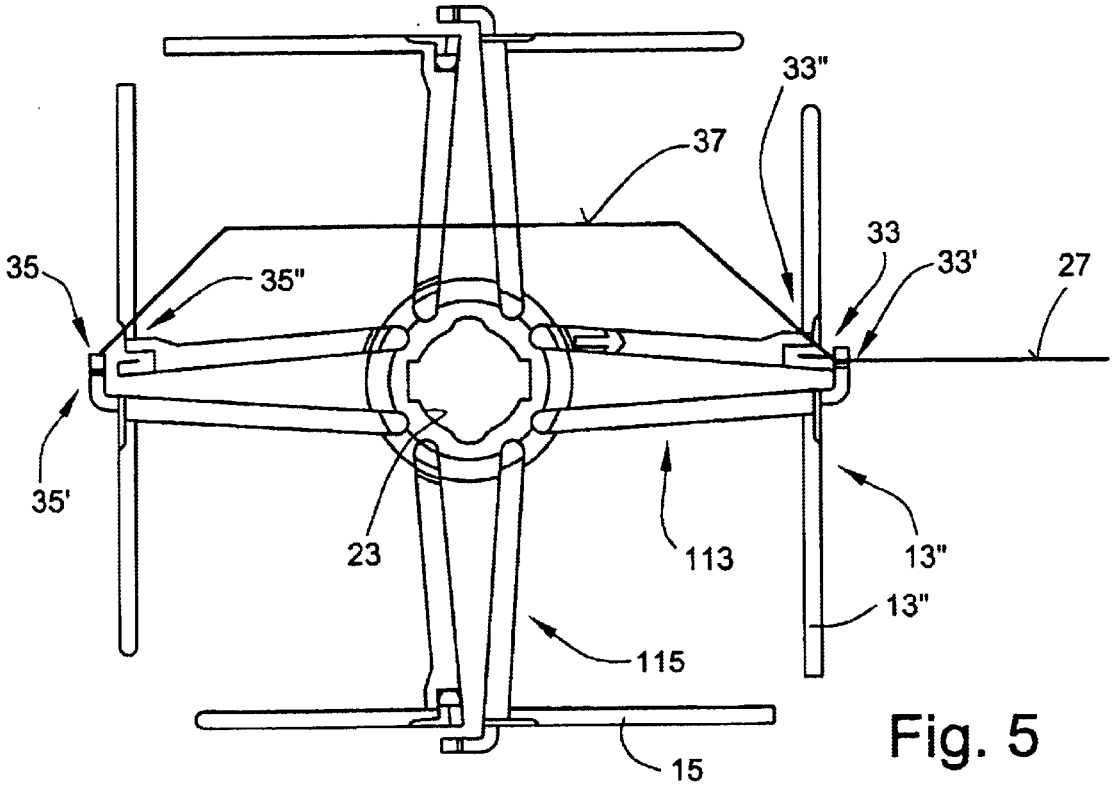
FIG. 5 shows a top view of the exemplary implementation according to FIG. 4.

By comparison, according to the exemplary non-limiting illustrative implementation, a feed according to FIGS. 4 and 5 is now carried out in which the feed cable 27 (e.g. coaxial cable) is conducted directly to the feed point 33 at a dipole. The feed cable 27 is there again electrically connected to the feed point 33' (which is connected to one dipole half) with its internal conductor, and the external conductor 31*b* is electrically connected to the other dipole half at feed point 33'.

From this feed point 33, a connecting cable 37 leads to the feed point 35 at the opposite dipole half. In this exemplary non-limiting arrangement, the inner conductor is again electrically connected to one dipole half via the connecting point 35' and the outer conductor is connected to the second dipole half at 35".

In practice, the feed cable is also run here, via the hole 23 at one support arm or in one support arm of the balancing arrangement 113' or 113" (if this is constructed, for example, as a waveguide or hollow support) in the interior and conducted to the feed point 33. At feed point 33, the outer conductor is electrically connected to one dipole half and the inner conductor is connected to the connecting point of the second dipole half. The coaxial connecting cable 37 is similarly conducted back again in the direction of the reflector plate 9' from the feed point 33 at one dipole at or, for example, in the second support arm 113' or 113" of the corresponding balancing arrangement 113. The cable 37 may for example be conducted in the possibly hollow support arm of the opposite balancing arrangement 113 of the opposite dipole 13' to its feed point 35 located at the top.Alternatively, it can be run at the balancing arrangement or in another suitable manner. FIGS. 1, 4 and 5 show the principle of interconnection which is why the respective feed cable 27 is shown conducted to the feed point coming virtually from the outside although, in practice, it is conducted along the balancing arrangement to the feed point 33 coming via the central hole 23.

In one exemplary implementation, the length of the connecting cable should be λ or an integral multiple thereof referred to the frequency range to be transmitted, particularly the center frequency range.

Correspondingly, the feeding to the two dipoles 15 and 115, located offset by 90° in the exemplary implementation of FIGS. 4 and 5, is carried out via a separate feed cable or a corresponding separate connecting cable. There, too, a feeding via a separate feed cable takes place first at one dipole 15' and at a feed point constructed there. From there, a separate connecting cable is then conducted to an opposite dipole 15" and connected to a corresponding feed point.

FIG. 1 shows by way of example that the dipole halves 13' and 15' (shown located on the left in each case), are fed there at a corresponding feed point 35 via two separate feed cables 27. Connecting cables 31 lead from there to the in each case opposite dipoles 13" and 15", respectively, to feed points provided there.

Thus, for example, all dipole squares 3 which are larger in FIG. 1, but also all smaller dipole squares 5, can be fed in the same manner.

It is also possible that, for example, a single dipole square or, in the case of even more dipole squares arranged above one another vertically, for example one half or any other combination of dipole squares are fed differently. Thus, it is shown, for example with respect to the lowest dipole square 3 in FIG. 1, that feeding takes place via two separate feed cables at the dipoles on the right in the dipole square(namely at dipole 13" and dipole 15", at the feed points explained). The feeding at the opposite parallel dipole is then, in one exemplary arrangement, carried out in each case starting from the first feed point via two separate connecting lines 31.

Depending on whether the first feeding takes place and which of the dipoles, which are in each case parallel in pairs, of a dipole square is connected electrically by the connecting line starting from the first dipole, a different measure of the tracking is also obtained.

Figure 6:
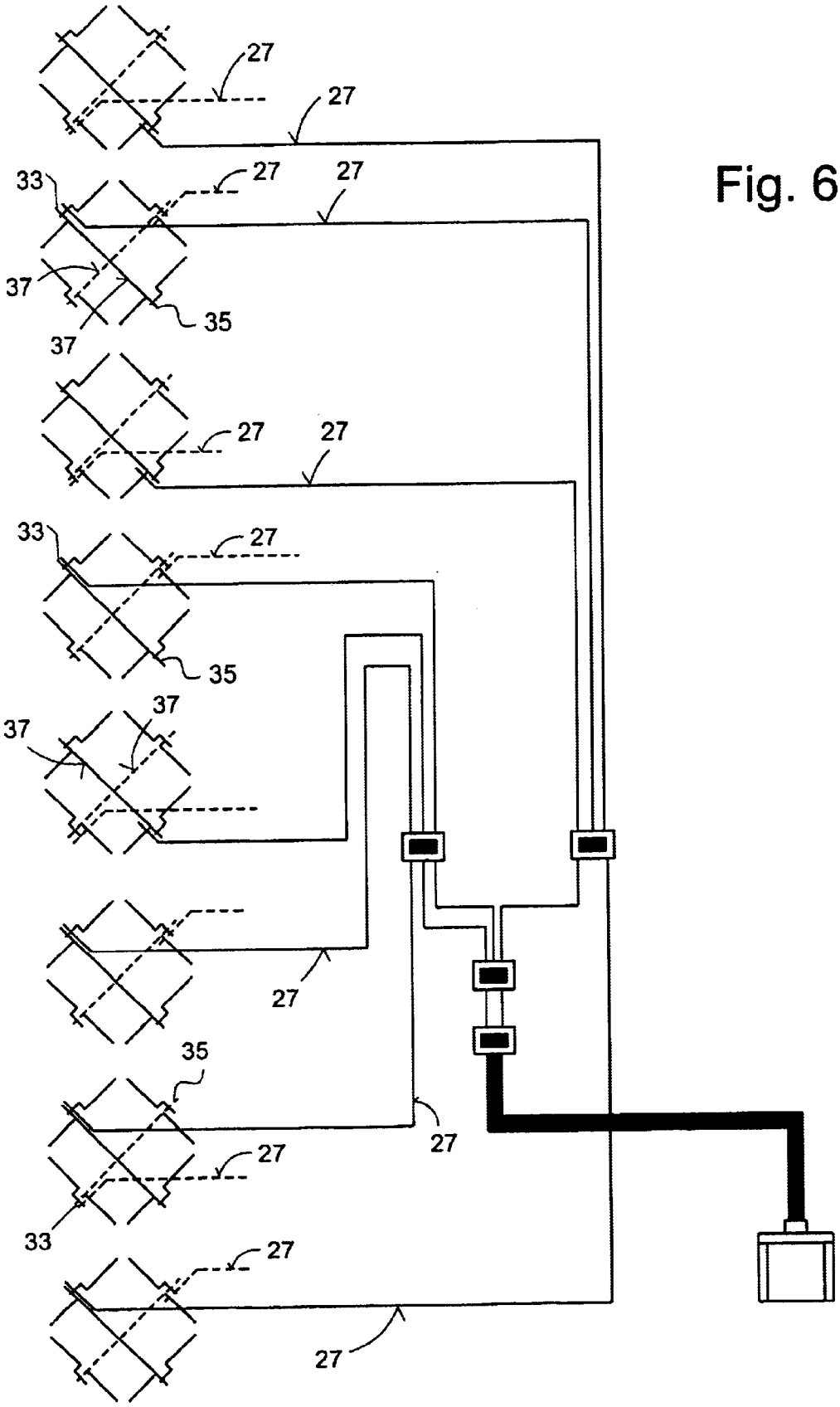
FIG. 6 shows a diagrammatic representation of an exemplary non-limiting implementation of eight dipole squares, arranged vertically above one another and rotated by 45° inclination, with differently located feed points.
Figure 7:
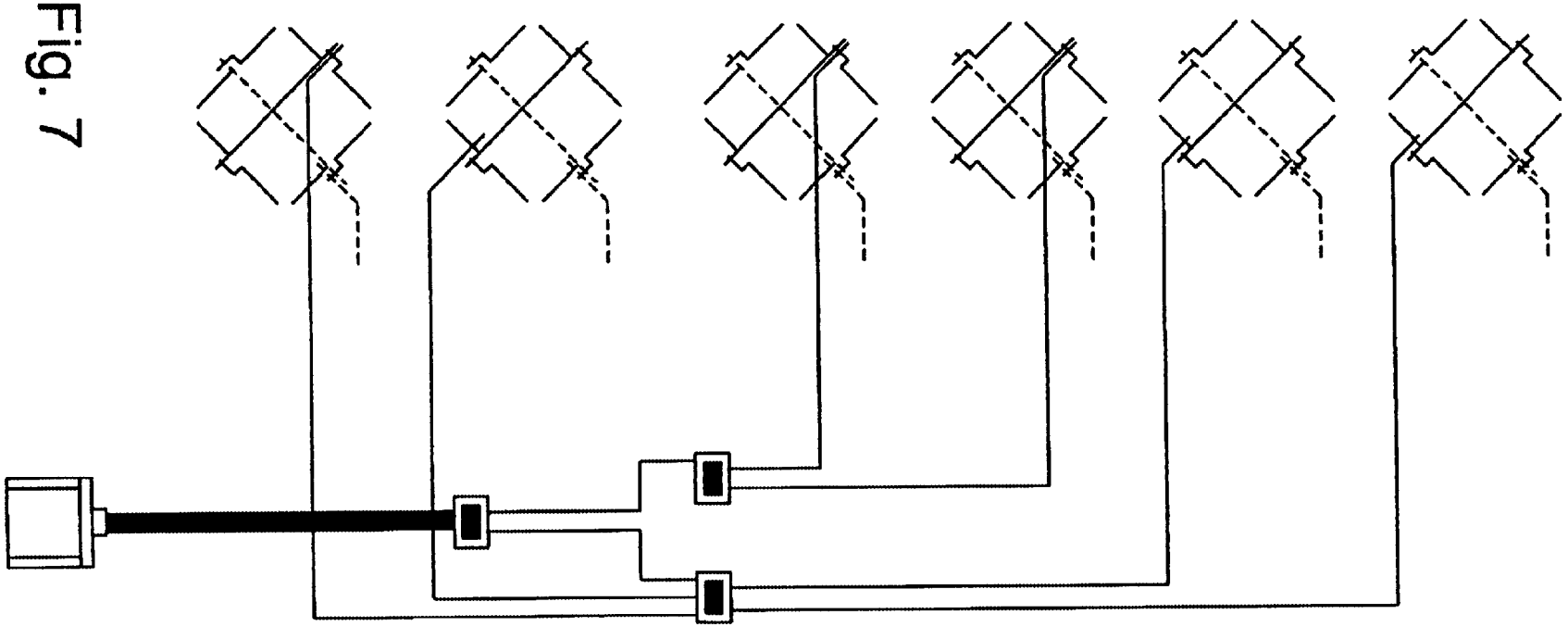
FIG. 7 shows a further exemplary implementation, slightly modified, with six dipole squares arranged above one another and with differently located feed points.

FIGS. 6 and 7 show two illustrative non-limiting examples of one set of eight dipole squares arranged one above another in 45° orientation which, to achieve a quite particular value for the tracking, exhibit different feeding with respect to the dipoles on the left or with respect to the dipoles on the right. This correspondingly applies to the exemplary implementation according to FIG. 7 which shows six dipole squares arranged above one another in 45° orientation. The feeding for the various dual-polarized dipole squares is implemented starting in each case from a main feed line 27 via subsequent distributors and taps. The reflector plate of FIG. 1 is not shown in FIGS. 6 and 7 for the sake of clarity.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

What is claimed is:

1. A dual-polarized dipole antenna comprising:

at least one dipole square oriented rotated at a 45° angle with respect to the vertical or horizontal, said dipole square including first and second opposite parallel dipoles;

a feed cable connected to a feed point at the first dipole; and a connecting cable run to the feed point at the second, opposite parallel dipole of the dipole square and electrically connected to the dipole halves of the dipole square.

2. The antenna as claimed in claim 1, further comprising:

two separate feed cables for said dipole square, the two feed cables leading to the feed points of two dipoles located offset by 90°, and separate connecting lines leading from said feed points to further feed points on respective opposite parallel dipole.

3. The antenna as claimed in claim 1, further comprising plural dipole squares arranged above and/or next to one another along a direction of installation, the feed points connected to the feed cables being located at a correspondingly common points or orientations at each of said dipole squares.

4. The antenna as claimed in claim 1, further comprising plural dipole squares arranged above and next to one another along a direction of installation, which feed points connected to the feed cables are located at the respective other one of the dipoles parallel with one another in pairs.

5. The antenna as claimed in claim 1, further comprising support arms of dipole balancing arrangements, and wherein connecting lines are run from a first feed point at one dipole to a further respective feed point at the dipole parallel thereto at or within the support arms.

6. The antenna as claimed in claim 5, wherein the connecting cables have different line cross sections.

7. The antenna as claimed in claim 1, wherein a reduction in the frequency-dependence of the orientation of the copolar and/or cross polar radiation patterns (tracking) is obtained in dependence on the feeding arrangement at each dipole square.

8. A dual-polarized dipole antenna comprising:

at least one dipole square for, in use, being disposed at an orientation that is rotated substantially at a 45° angle with respect to vertical and horizontal, said dipole square comprising plural first dipoles located offset and opposite the square and parallel with respect to one another and plural further dipoles located offset and opposite the square and parallel with respect to one another, one of said first dipoles including a feed point;

a coaxial feed line connected to said first dipole feed point; and a coaxial connecting line connected from the first dipole feed point to a further one of the first opposite parallel dipoles to electrically connect dipole halves of the dipole square, wherein the electrically effective length of the coaxial connecting line is chosen such that the respectively opposite parallel dipoles are excited in phase.

9. The antenna of claim 8 wherein the electrically effective length of the coaxial connecting line is at least approximately an integral multiple of wavelength $\lambda$ with respect to the frequency band range to be transmitted.

* * * * *